United States Patent [19]

Eber

[11] 4,185,470

[45] Jan. 29, 1980

[54] RECTIFIER FOR ABSORPTION COOLING UNIT

[76] Inventor: Nicolas Eber, P.O. Box 130, CH-8103 Unterengstringen, Switzerland

[21] Appl. No.: 825,083

[22] Filed: Aug. 16, 1977

[30] Foreign Application Priority Data

Sep. 2, 1976 [CH] Switzerland ..... 011259/76

[51] Int. Cl.[2] ..... F25B 15/04

[52] U.S. Cl. ..... 62/496; 62/497

[58] Field of Search ..... 62/495, 310, 314, 496, 62/497

[56] References Cited

U.S. PATENT DOCUMENTS

| | | | |
|---|---|---|---|
| 2,337,870 | 12/1943 | Coons | 62/495 |
| 3,253,421 | 5/1966 | Grubb | 62/148 |
| 3,864,937 | 2/1975 | Asher et al. | 62/497 |

FOREIGN PATENT DOCUMENTS

| | | | |
|---|---|---|---|
| 709056 | 5/1954 | United Kingdom | 62/495 |

*Primary Examiner*—Lloyd L. King
*Attorney, Agent, or Firm*—Kenyon & Kenyon

[57] ABSTRACT

The rectifier is formed by two concentric pipes which are disposed to define a counter-current flow path and a plurality of spherical calotte-shaped or similar indentations in the outer pipe. The indentations are formed simultaneously in staggered rows (1) to divide the flow path into a plurality of small parallel passages and (2) to secure and fix the mutual position of the two pipes relative to each other. The cross-sections of the formed passages have a maximum linear dimension of five millimeters (5 mm.).

8 Claims, 3 Drawing Figures

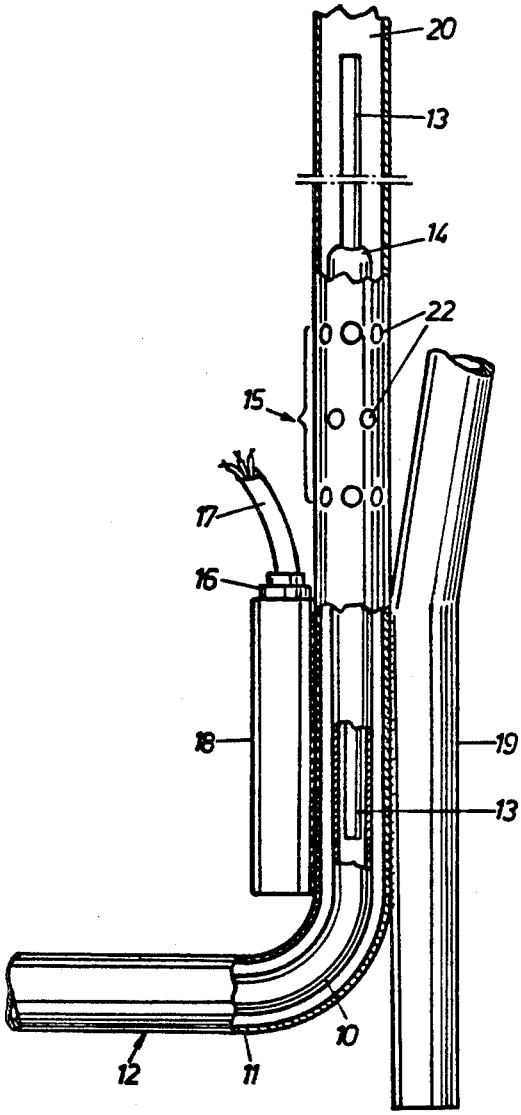
Fig. 1
Fig. 2
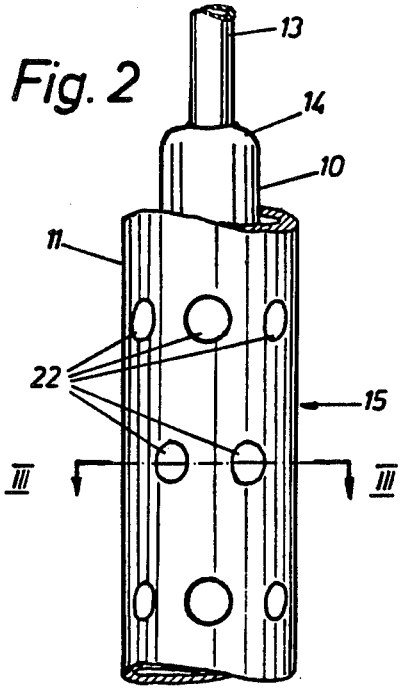
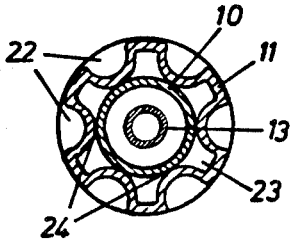
Fig. 3

RECTIFIER FOR ABSORPTION COOLING UNIT

This invention relates to a rectifier, and particularly to a rectifier for an absorption cooling unit.

Various types of rectifiers have been known for use in an absorption cooling unit, for example, in connection with a boiler of the cooling unit. In some cases, the rectifier has employed two pipes, arranged one inside the other, so that a flow path is provided for a downward flow of a previously raised absorption solution and an upward flow of a vapor which is generated within a heat input zone of a boiler located below the rectifier. In addition, the rectifier has a plurality of constrictions in the flow path. As proposed in U.S. Pat. No. 3,864,937, these constrictions are usually produced by a deformation, such as by stamping the pipes, preferably of the external pipe, which enclose the rectifier flow path. Proposals are also known which use constrictions with a constant as well as with a variable radial width. The constrictions act as a rectifier in that, in addition to preventing the intermixture of solutions with low and high refrigerant content which are present at different parts of the boiler, they also ensure an efficient heat and mass transfer between the relatively cold and rich solution flowing downwards and the relatively hot and poor vapor mixture flowing upwards. A proper functioning of the rectifier is therefore essential for the efficiency of the boiler and, consequently, also for the efficiency of the entire cooling unit.

However, previously known rectifiers of the aforementioned type require high standards for manufacturing accuracy, since the slots produced by the constrictions between the pipes must have at least in some places, a radial width of not more than one millimeter (1 mm). Under such conditions, the otherwise admissible and standard variations in the diameter and wall thickness of the pipes can inherently lead to undersirable and inadmissible deviations in the width of the slots. A further requirement to ensure the necessary slot width is the accurate mutual centering of the pipes which enclose the rectifier. This can be only obtained in the already known constructions, by additional measures, preferably by use of centering indents, both below as well as above the rectifier proper. The centering indents, however, increase the height occupied by the entire rectifier considerably—up to 50%. This is disadvantageous both from a constructional and an operational point of view. Further, during the production of the centering indents, the previously made rectifier indents are subject to the risk of unintended modifications and vice versa as well.

Accordingly, it is an object of the invention to provide a rectifier which can be made in a relatively simple and inexpensive manner without the need of additional parts.

It is another object of the invention to provide a rectifier of relatively efficient construction without an excessive increase of wetted surfaces as compared to previously known rectifiers.

It is another object of the invention to limit corrosion in the wetted surfaces of a rectifier.

It is another object of the invention to eliminate the need for additional centering indentations in a rectifier made of a pair of pipes with passage defining indentations.

It is another object of the invention to provide a rectifier of self-centering construction.

It is another object of the invention to provide a rectifier in which the manufacturing tolerances of the pipes of the rectifier do not adversely effect the size of the flow passages of the rectifier.

It is another object of the invention to provide an efficient rectifier of limited height.

Briefly, the invention provides a rectifier for an absorption cooling unit which includes a pair of concentrically disposed pipes defining a counter-current flow path therebetween for a downward flow of a liquid solution and an upward flow of a vapor mixture and a plurality of indentations in at least one of the pipes. The indentations serve to divide the flow path between the pipes into a plurality of small parallel passages and to simultaneously secure and fix the mutual position of the pipes relative to each other.

The indentations are arranged preferably in the external pipe and are, for example, of spherical calotte shape, which are arranged in several, preferably staggered rows above each other and project so far, that they touch the other pipe. Consequently, the indentations center the two pipes. The multitude of the resulting small passages and corners enable the unobstructed counterflow of liquid and vapor under simultaneous intensive contact, and consequently, efficient heat and mass transfer. Due further to the small daming effect of such indentations, the pumping head of the thermosyphon pump is also reduced.

These and other advantages of the invention will become more apparent from the following detailed description and appended claims taken in conjunction with the accompanying drawings in which:

FIG. 1 illustrates a boiler of an absorption cooling unit with an incorporated rectifier according to the invention;

FIG. 2 illustrates on a larger scale, one part of the rectifier of FIG. 1; and

FIG. 3 illustrates a view taken on line III—III of FIG. 2.

Referring to FIG. 1, the absorption cooling unit has a boiler composed in part of a pair of concentric coaxial pipes 10, 11 which are connected via a liquid heat exchanger 12 to an absorber (not shown) of the cooling unit.

The inner pipe 10 is connected to the absorber (not shown) of the unit and conducts a solution enriched with refrigerant, consisting for example of water and ammonia, to the boiler. In addition, a pump pipe 13 is arranged within the boiler. This pump pipe 13 is secured to and extends into the inner pipe 10 to conduct a flow of liquid solution and vapor mixture upwardly from the inner pipe 10. The pump pipe 13 also terminates within the outer pipe 11 to permit a separation of the liquid solution from the vapor mixture.

As shown, the inner pipe 10 encloses the pump pipe 13 and is closed at the upper end 14, above a rectifier 15, by a welding to the pump pipe 13.

Heat is supplied to the boiler by an electric heating element 16, which is connected through a cable 17 to a electric mains or to a battery. The heating element 16 is enclosed by a metallic housing 18, which is connected by welding to the external pipe 11. The external pipe 11 is also connected by welding to a flue pipe 19. In this way, it is possible to heat the boiler alternately by the electric heating element 16 or by gas or kerosene from a burner (not shown) situated below the flue pipe 19. When the boiler is heated, the generated vapors lift the liquid solution through the pump pipe 13. The vapors then flow to a condenser (not shown) via a vapor duct 20, which is an elongation of the external pipe 11. The liquid solution lifted by the pump flows downwardly into the external pipe 11 and passes downwards through the heated part of the boiler and the liquid heat exchanger 12 before passing to the top of the absorber (not shown). When the solution passes the heated part of the boiler in the external pipe 11, additional vapor is generated therefrom. This additional vapor then flows upwards through the rectifier 15 in counterflow to the liquid solution.

Heat and mass are transfered in the rectifier between the liquid solution and the vapors in order to increase the refrigerant mass fraction of the vapor mixture during travel to the condenser. Such transfer is performed in a very efficient way in the rectifier.

Referring to FIGS. 2 and 3, the rectifier 15 is formed, in part, by the pipes 10, 11 which form a flow path for the downward flow of liquid solution from the pump pipe 13 and the upward flow of the generated vapor mixture. In addition, the rectifier 15 includes a plurality of indentations of spherical calotte shape which are arranged in rows perpendicular to the pipe axis, on the outer pipe 11, to form a plurality, e.g., six, small individual parallel passages 23. These small passages 23 ensure that the vapor can only pass upwards in the form of small bubbles with a large specific surface, which is favorable for the heat and mass transfer. The liquid, on the other hand, flows, due to capillary forces, preferably in the corners 24 created through the contact between the indentations 22 and the inner pipe 10 and also along the pipe walls, downwards and exposes a large specific surface. The indentations 22 and passages 23 are arranged in a staggered array vertically, i.e., in relation to the main flow direction. This ensures further repeated distribution and blending of the individual streams fractions. Further, the indentations 22 serve to secure and fix the mutual position of the pipes 10, 11 relative to each other. As such, the rectifier is selfcentering. The size and number of the indentations 22 and of the resulting passages 23 have to be chosen with consideration of the capillary effects, so that, on one hand, an efficient heat and mass transfer is ensured, which means that small vapor bubbles have to be formed, and, on the other hand, that the created flow resistance and pressure drop do not become excessive. For usual performance and size of the cooling unit this is best obtained when the indentations are formed by balls of about four millimeters (4 mm) diameter, and the passages 23 have a cross-section with a linear dimensions no greater than about four millimeters (4 mm), and under no circumstances more than five millimeters (5 mm). This results in practice in normally four to eight indentations per section or row, and the same number of passages. The number of indentation rows to be at least three, as in the example shown, with a distance of about twenty millimeters (20 mm) from each other.

When producing such rectifiers, it is essential to make all indentations simultaneously in one operation, as otherwise, undesirable secondary deformation of the previously made identations might occur.

The invention thus provides a rectifier which can be made in a relatively simple and inexpensive manner.

The present invention enables further savings by making additional centering indents superfluous. This follows from the fact, that the rectifier, is self-centering. Besides, the rectifier does not contain slot shaped constrictions, the dimensions of which could be influenced by the manufacturing tolerance of the pipes. Further, due to the suppression of extra centering indents, a significantly smaller height is needed for the achievement of an equivalent effect.

What is claimed is:

1. A rectifier for an absorption cooling unit comprising a pair of concentrically disposed pipes defining a counter-current flow path therebetween for a downward flow of a liquid solution and an upward flow of a vapor mixture of a refrigerant and a solvent; and a plurality of indentations in at least one of said pipes dividing each flow path into a plurality of small parallel passages, each having a cross-section with a maximum linear dimension of five millimeters, and simultaneously securing and fixing the mutual position of said pipes relative to each other.

2. A rectifier as set forth in claim 1 wherein said indentations are of spherical calotte or similar shape and are disposed in the outer pipe of said pair of pipes.

3. A rectifier as set forth in claim 2 wherein said indentations are arranged in a plurality of rows, said rows being disposed perpendicular to a longitudinal axis of said one pipe and in parallel to each other.

4. A rectifier as set forth in claim 2 wherein said indentations are disposed in a staggered array vertically.

5. A rectifier as set forth in claim 1 wherein said indentations are arranged in a plurality of rows, said rows being disposed perpendicular to a longitudinal axis of said one pipe and in parallel to each other.

6. A rectifier as set forth in claim 1 wherein said indentations are disposed in a staggered array vertically.

7. The combination of a pair of concentrically disposed pipes defining a counter-current flow path therebetween for a downward flow of a liquid solution and an upward flow of a vapor mixture of a refrigerant and a solvent;

a pump pipe secured to and extending into the inner pipe of said pair of pipes to conduct a flow of liquid solution and vapor mixture upwardly from said inner pipe, said pump pipe terminating within the outer pipe of said pair of pipes to permit a separation of the liquid solution from the vapor mixture in the flow conducted therethrough;

a heating means adjacent said outer pipe for heating the flow of liquid solution therein; and a rectifier above said heating means, said rectifier including said pair of pipes, said pump pipe and a plurality of indentations in at least one of said pair of pipes dividing said flow path into a plurality of small passages, each having a cross-section with a maximum linear dimension of five millimeters, and simultaneously securing and fixing the mutual position of said pair of pipes relative to each other.

8. A rectifier for an absorption cooling unit comprising a pair of concentrically disposed pipes defining a counter-current flow path therebetween for a downward flow of a liquid solution and an upward flow of a vapor mixture of a refrigerant and a solvent; and a plurality of vertically spaced rows of indentations in at least one of said pipes dividing said flow path into a plurality of small parallel passages in each said row and simultaneously securing and fixing the mutual position of said pipes relative to each other, and indentations being disposed in a staggered array vertically.

* * * * *

UNITED STATES PATENT AND TRADEMARK OFFICE

CERTIFICATE OF CORRECTION

PATENT NO. : 4,185,470

DATED : January 29, 1980

INVENTOR(S) : Nicholas Eber

It is certified that error appears in the above—identified patent and that said Letters Patent is hereby corrected as shown below:

Column 3, line 36, change "streams" to --stream--

Column 3, lines 38-39, change "selfcentering" to --self-centering--

Column 3, line 53, after "rows" insert --has--

Column 4, line 66, change "and" to --said--

Signed and Sealed this

*Twenty-fourth* Day of *June 1980*

[SEAL]

*Attest:*

SIDNEY A. DIAMOND

*Attesting Officer*

*Commissioner of Patents and Trademarks*